United States Patent [19]

Rutten et al.

[11] Patent Number: 4,534,306

[45] Date of Patent: Aug. 13, 1985

[54] SEA ANCHOR

[75] Inventors: Peter T. Rutten, Plainfield, Ill.; James E. Kalinowski, Minneapolis, Minn.

[73] Assignee: Blue Harbor, Inc., Minneapolis, Minn.

[21] Appl. No.: 503,905

[22] Filed: Jun. 13, 1983

[51] Int. Cl.[3] ..... B63B 21/48

[52] U.S. Cl. ..... 114/311; 114/294; 244/152

[58] Field of Search ..... 114/311, 300, 294; 244/142, 152

[56] References Cited

U.S. PATENT DOCUMENTS

| | | | |
|---|---|---|---|
| 396,229 | 1/1889 | Pagan | 114/311 |
| 2,100,231 | 11/1937 | Armstrong | 114/311 |
| 3,134,355 | 5/1964 | Jakosky | 114/311 |
| 3,842,778 | 10/1974 | Shibata | 114/311 |
| 4,299,184 | 11/1981 | Mougin | 114/311 |

FOREIGN PATENT DOCUMENTS

| | | | |
|---|---|---|---|
| 13553 | 6/1903 | United Kingdom | 114/311 |
| 15699 | 10/1980 | United Kingdom | 114/311 |
| 2117339 | 10/1983 | United Kingdom | 114/311 |

*Primary Examiner*—Galen L. Barefoot
*Assistant Examiner*—C. T. Bartz
*Attorney, Agent, or Firm*—Trexler, Bushnell & Wolters

[57] ABSTRACT

A tandem array of sea anchors is provided. Each sea anchor is generally umbrella shaped and has a relatively small opening at the apex. A single tow rope from a boat is secured to a plurality of strands from the periphery of each sea anchor and extends through these small apex openings of each sea anchor save the last. A single control cable also extends through the apex opening of each sea anchor save the last and is secured to each sea anchor adjacent the apex opening for simultaneously partially inverting said sea anchors to vary the drag of said tandem array of sea anchors. The number of anchors can be varied in accordance with the size, etc. of a boat.

2 Claims, 2 Drawing Figures

SEA ANCHOR

RELATED APPLICATION

The present invention comprises an improvement on our prior invention as disclosed and claimed in our co-pending application for "Sea Anchor" filed on Mar. 25, 1982, under Ser. No. 361,829 now U.S. Pat. No. 4,481,900; issued Nov. 13, 1984 and assigned to the same assignee as the present application, Blue Harbor, Inc. of Bloomington, Minn.

BACKGROUND OF THE INVENTION

Sea anchors are known in the nautical arts and are used for many purposes. Sea anchors are somewhat in the form of a parachute, and are deployed beneath the surface of the water and resist moving through the water. A sea anchor may be used to more or less anchor a boat aganst the movement of the wind and surface currents when it is desired to fish from the boat, for example. A sea anchor may also be very useful with a boat that is used for trolling. In larger boats, both inboard and outboard, and also the inboard-outboard variety, it is often not possible to slow the engine down to a proper point for achieving the necessary low speed for trolling. A sea anchor may be used to slow the speed.

Prior sea anchors are generally fixed in the extent to which they can provide resistance to movement through the water. Thus, while a given sea anchor may be quite satisfactory for obtaining trolling speed with one boat, it may be entirely unsatisfactory for a different boat. Furthermore, conventional sea anchors are difficult to return to the boat, except for certain sea anchors that may be inverted for retrieval. However, such latter anchors cannot then be redeployed without being taken on board the boat, thus precluding the possibility of repositioning the sea anchor relative to the boat without entirely removing the sea anchor from the water.

In accordance with our aforesaid prior application Ser. No. 361,829, now U.S. Pat. No. 4,481,900; issued Nov. 13, 1984 we have provided a sea anchor with a central opening. The opening is adjustable as to size, and preferably is adjustable before the sea anchor is placed in the water, but may be adjusted while in the water, thus to determine the maximum drag attainable, in accordance with the necessity of a given boat. Furthermore, the sea anchor is provided with pull-type controls from the boat for turning the sea anchor partially inside out, and thus markedly to vary the amount of drag to be attained, less than the maximum drag. Turning of the anchor substantially inside out markedly reduces the drag so that the anchor can be pulled toward the boat without great effort. However, since the sea anchor is never turned completely inside out, it can be substantially instantly redeployed from the boat without the necessity of hoisting it aboard the boat.

In utilizing the aforesaid sea anchor of our prior application Ser. No. 361,829, now U.S. Pat. No. 4,481,900; issued Nov. 13, 1984 we have found that very large boats require a sea anchor which is very large, and which sells in relatively restricted quantities, with a different anchor for each size, thereby making manufacture of such very large anchors economically impractical.

However, in experimenting further we have discovered that a plurality of smaller anchors can be utilized in tandem, thereby attaining a greater anchoring effect, and permitting the anchoring effect to be scaled appropriately to the size of the boat, thus avoiding the necessity of producing more or less custom sizes.

OBJECTS AND SUMMARY OF THE PRESENT INVENTION

It is the object of the present invention to provide a plurality of sea anchors constructed in accordance with our prior application Ser. No. 361,829, now U.S. Pat. No. 4,481,900; issued Nov. 13, 1984 deployed in tandem and operated by a single anchor rope and a single control rope.

As heretofore noted and as set forth in greater detail in our co-pending application Ser. No. 361,829, now U.S. Pat. No. 4,481,900; issued Nov. 13, 1984 the sea anchor of that invention is shaped somewhat like a parachute with a central opening in the shroud. Webbing members are provided for attachment of the sea anchor to a deployment rope. In accordance with the present invention the single deployment rope extends through the opening of the first anchor and through subsequent anchors seriatim down to the last anchor of a tandem arrangement. Similarly, a sing1e control rope passes through the openings of the successive tandem anchors.

THE DRAWINGS

The present invention will best be understood with reference to the accompanying drawings when taken in connection with the accompanying specification. In the drawings:

FIG. 1 comprises a perspective view of a plurality of sea anchors deployed in tandem arrangement in accordance with the present invention; and FIG. 2 comprises a longitudinal sectional view through any of the sea anchors, f.i. the first, other than the last one.

DETAILED DESCRIPTION OF THE DISCLOSED EMBODIMENT

A plurality of sea anchors 16-1, 16-2, and 16-3, is deployed in tandem arrangement, being secured to a boat (not shown) by a suitable cable or rope structure 17. With power on the boat shut off the sea anchors determine the position of the boat by applying a drag thereto, acting against winds, or surface currents, so that a fisherman may maintain the boat where he wants it. Similarly, a disabled boat may be kept in a particular location for rescue. With power on, the sea anchors will slow the boat to a proper speed such as for trolling. The number of sea anchors in the tandem array, shown as 3 for example, may be any practical plurality from two up through a fairly large number. The sea anchors are all identical, and one will be described hereinafter. Small details of disclosure may be obtained, from our co-pending application Ser. No. 361,829 now U.S. Pat. No. 4,481,900; issued Nov. 13, 1984.

Figure 1:
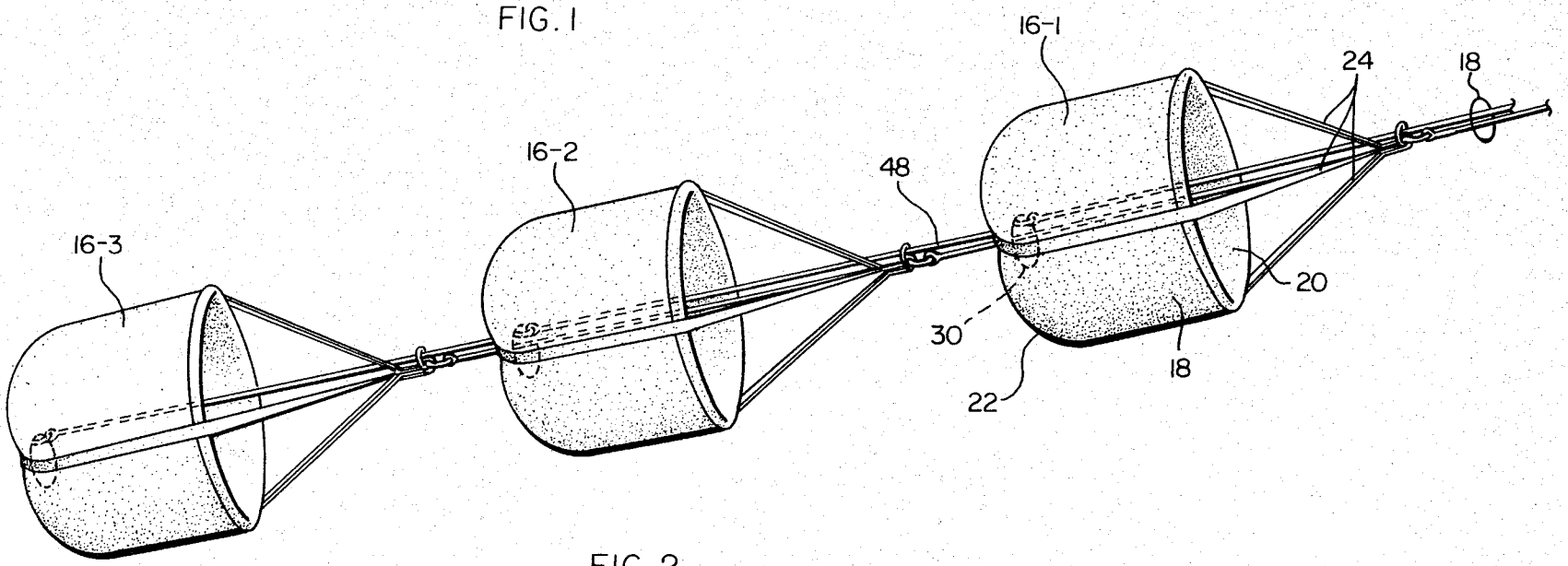
Figure 2:
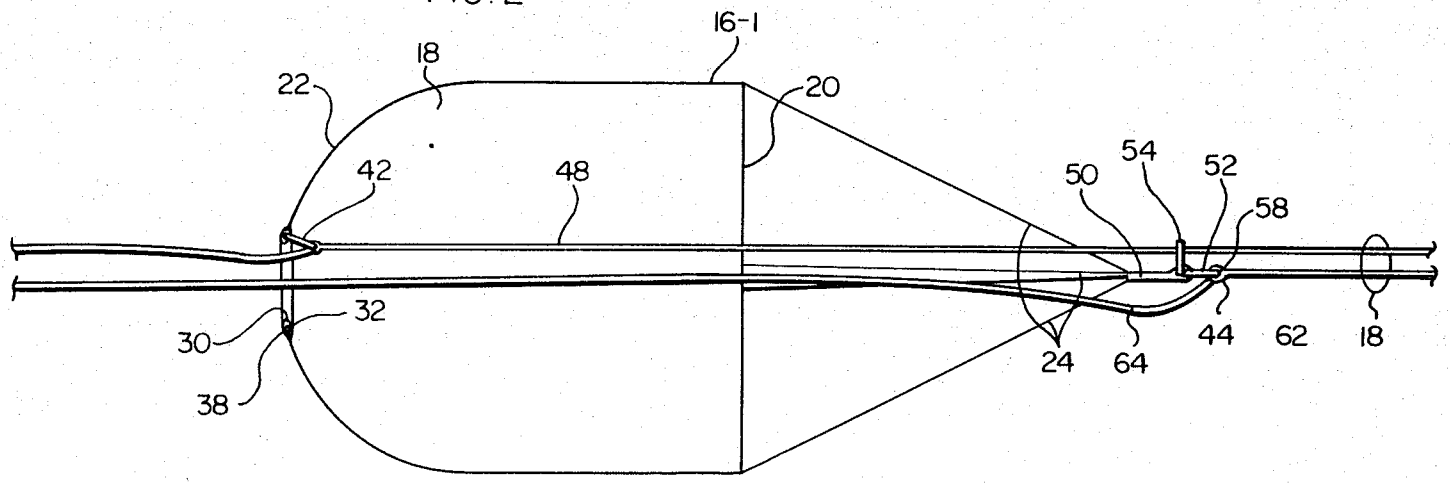

Each sea anchor, such as the anchor 16-1, shown in FIGS. 1 and 2, comprises a generally cylindrical body portion 18 open at the front end as indicated at 20, and having a dome shaped trailing end 22 which is nearly closed. The sea anchor is made of fabric, preferably a synthetic such as nylon or polyester, and comprises conveniently one or a plurality of panels sewn together along with tapes or straps 24 (illustrated as four in number) stitched to the cloth such as along the seams and connected to a tow rope as will be described hereinafter, and forming a part of the cable or rope structure 17. As described in our co-pending application Ser. No. 361,829, now U.S. Pat. No. 4,481,900; issued Nov. 13, 1984 but not shown herein, the sea anchor adjacent its open end 20 is provided with openable pockets containing sections of foam or lead for determining the depth at which the sea anchor will operate.

The dome shaped trailing end 22 is not quite closed, having an aperture 30 therein. The opening is defined by a hem 32 stitched in the fabric of the sea anchor. A rope 38 extends through the hem, and has the ends thereof extending out through an opening in the hem and preferably encircled by a reinforcing grommet (opening and grommet not shown herein). The rope 38 can be drawn up to a greater or lesser degree before lashing, thus to determine the size of the opening 30. As will be understood, the size of the opening has a very considerable effect on the maximum drag to be exerted by the sea anchor. Such adjustment of the diameter of the aperture 30 is normally made before the sea anchor is immersed in the water, and the diameter will depend on the power of the boat which is to be slowed for trolling, the necessary speed, and other factors, or by the weight of the boat which is to be anchored. A ring 42 is secured adjacent the opening 32 by the tucked over and stitched end of one of the tapes 24 and has secured thereto by means such as a knot or other suitable loop in a control rope 48 forming a part of the cable 17. This control rope extends through the opening 30 in the first sea anchor 16-1 and on to a similar ring connection in the second tandem sea anchor 16-2, and through the opening in that sea anchor and on to another ring connection of the sea anchor 16-3. This continues seriatim in the event that there are further anchors connected in tandem. In accordance with our prior application Ser. No. 361,829, now U.S. Pat. No. 4,481,900; issued Nov. 13, 1984 the rope 48 alternatively may be tied to the rope 38 in the hem defining the opening 30 to effect restriction of the opening 30 by pulling on the control rope 48. Subsequent reduction of tension on the control rope will then allow the opening to return to the preset maximum size.

As set forth in greater detail in our aforesaid co-pending application, and merely mentioned at this point, two of the straps 24 comprise a continuous tape or strap looped over at 50 and securing two rings 52 and 54. The surfaces of these two straps or strap portions are straight and untwisted and form a flat section adjacent the loop 50. The other two straps must be twisted 90 degrees to fit between the first two straps and the flat section 56 and in the loop 50, the entire being stitched together. Of these two straps, one is twisted in one direction, and the other in opposite direction to prevent spiraling of the sea anchor as it is pulled through the water. It has been found that the flat straps are far superior to ropes in avoiding tangling. The ring 52 has a spring clip 58 secured thereto and having a swivel connection to a rope 62 forming a part of the cable or rope assembly 17. Alternatively, the rope 62 may be tied directly to the ring 52. The ring 54 serves as a guide for the rope 48, and as a limit stop for the hem 32 about the aperture 30. In one practical construction of the present invention the rope 48 is of a distinctive coloring for guidance of the boat.

For illustrative purposes only the rope 62 immediately to the left of the clip 58 in FIG. 2 is shown as relaxed, having a loop 64 therein. This loop would not actually be present, since the rope 64 continues on through the opening 30 at the back of the sea anchor and on to a similar connection to the straps of the sea anchor 16-2. The rope 62 further continues through the opening of that sea anchor to the ring connection at the front of the sea anchor 16-3. As will be understood, this could be continued seriatim depending on the number of sea anchors in the tandem array.

As is shown and described in some detail in our aforesaid co-pending application, the sea anchor is fully deployed as in the drawings of the present application. The tandem array of sea anchors presents a maximum drag on the boat to which it is attached, commensurate with the maximum drag desired for the size of the boat. It will be realized that the rope 48 can be pulled independently of the rope 62, whereby the rear end of the sea anchor can be pulled into the interior thereof. This results in a partial inversion of the three illustrative sea anchors, and as this inversion progressviely increases, the drag becomes progressively less due to the decrease in depth (or axial length) of the respective sea anchors. As pull is continued on the rope 48 the tandem sea anchors will be almost completely turned inside out for ready return to the boat upon pulling on the rope 62. Beyond a certain point of turning the sea anchor inside out the material pulls somewhat radially inwardly so that the outer diameter of the anchor is substantially reduced, thus enhancing the reduction in drag effective by shortening the length of the body of the sea anchor.

The ring 54 is of small enough diameter that, although the rope 48 moves freely therethrough, the rope 38 and hem 32, etc. will not pass through the ring 54. Thus the degree to which the sea anchor can be turned inside out is limited. Accordingly, the sea anchor can never be completely turned inside out. Accordingly, release of the rope 48 permits ready redeployment of the tandem array of sea anchors.

It is important to note in connection with the present invention that a single deployment or tow rope is used to deploy or tow all of the plurality of sea anchors in the present tandem arrangement. Similarly, a sing1e control rope is utilized for all of the sea anchors in the illustrative embodiment. Alternatively, separate control ropes could be provided for the various sea anchors, but this complicates matters considerably and is really unnecessary since a sing1e rope provides all of the control that is needed.

The specific example of the invention as herein shown and described is for illustrative purposes. Various changes in structure will no doubt occur to those skilled in the art, and will be understood as forming a part of the present invention insofar as they fall within the spirit and scope of the appended claims.

The invention is claimed as follows:

1. A tandem array of sea anchors each made of cloth or the like and comprising a generally umbrella shaped body open at one end and having a relatively small opening at the apex thereof, a plurality of elongated tow members secured to the periphery of the open end in arcuately spaced fashion, a common tow cable adapted to be secured to a boat and secured to the elongated tow members of all of said plurality of sea anchors and extending freely through the apex opening of each sea anchor save the last, common control cable means adapted to be manipulated from a boat and secured to each of said sea anchors adjacent the respective apex opening, said tow cable means extending through the apex opening of each sea anchor save the last for partially inverting said sea anchors to vary the drag of said tandem array of sea anchors, said control cable means comprising a single cable for simultaneously partially inverting all of said sea anchors, the elongated tow members of each sea anchor being joined together at a junction forwardly of the respective sea anchor for securement to said tow cable, and guide means at each junction for said control cable means, and means on said control cable means engagable with said guide means to limit inverting of said sea anchors short of complete inversion.

2. A tandem array of sea anchors each made of cloth or the like and comprising a body open at one end and at least partially closed at the other end, said body including a tubular portion open at the front end and having a substantially hemispherical portion at the rear end tapering to a substantially closed apex, a plurality of elongated tow members secured to the periphery of the open end of each sea anchor in arcuate spaced relation, a common elongated tow rope which all of said tow members are connected for securement to a boat for sea-anchoring said boat, and additional means comprising a common line secured to each body substantially hemispherical portion apex and remotely operable from said boat for at least partly turning said bodies inside out, and guide means secured adjacent each connection of said tow members and said common tow rope and through which said common tow rope and through which said common line extend.

* * * * *